US006530306B1

(12) United States Patent
LaFleur

(10) Patent No.: US 6,530,306 B1
(45) Date of Patent: Mar. 11, 2003

(54) CLOSED BOLT FIRING DELAYED BLOWBACK AUTOMATIC HANDGUN FIREARM

(75) Inventor: Gary K. LaFleur, N. Chelmsford, MA (US)

(73) Assignee: Gary Kenneth La Fleur, North Chelmsford, MA (US)

( * ) Notice: Subject to any disclaimer, the term of this patent is extended or adjusted under 35 U.S.C. 154(b) by 0 days.

(21) Appl. No.: 09/560,806

(22) Filed: Apr. 28, 2000

(51) Int. Cl.[7] ..... F41A 3/44
(52) U.S. Cl. ..... 89/188; 42/70.08

(58) Field of Search ..... 89/188; 42/70.08

(56) References Cited

U.S. PATENT DOCUMENTS 4,575,963 A * 3/1986 Ruger et al. ..... 42/7.08
4,726,136 A * 2/1988 Dornaus et al. ..... 42/70.08
4,730,537 A * 3/1988 Matzagg et al. ..... 89/148

* cited by examiner

*Primary Examiner*—Stephen M. Johnson

(57) ABSTRACT

A telescopic breech bolt and breech bolt receiver for a closed bolt firing delayed blowback automatic firearm featuring, a thumbwheel operated rotating safety device which, locks the firing pin and the breech bolt with one single action.

4 Claims, 3 Drawing Sheets

CLOSED BOLT FIRING DELAYED BLOWBACK AUTOMATIC HANDGUN FIREARM

CROSS REFERENCE TO RELATED APPLICATIONS

Automatic Firearms

Telescoping Firearm Breech Bolts

Firearm Breech Bolt Lockback Mechanisms

Firearm Safety Devices

Handgun Firearm Fabrication Methods

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This new automatic handgun firearm like previous firearms was designed combining as many desirable qualities into one unit as possible. Firearm designers strive for a firearm that reloads fast and has the largest magazine capacity possible. It must perform flawlessly under the most severe weather conditions. It must be accurate and be weighted and balanced so that it feels completely natural when held.

The mistake firearm designers have made in the past was not putting enough emphasis on safety and many children have paid for this mistake with their lives.

This new firearm was designed with child safety as its first consideration, but, because of the invention of several new devices, no desirable qualities were sacrificed for safety sake.

This firearm is the bearer of three new firearm systems which makes it more reliable and reload faster than other automatic firearms and it has a component which detaches to completely disable it.

BRIEF SUMMARY OF THE INVENTION

This automatic handgun firearm invention is broken into four fields of invention. The first three are new firearm operating systems that are brought together into one firearm. This combining of systems into a single firearm is the fourth.

The new systems are the Trigger Operated Breech Bolt Lockback Releasing System, the Spinning-Lock Breech Bolt and Breech Bolt Receiver System and the Detachable Firing Assembly.

The Trigger Operated Breech Bolt Lockback Releasing (TLR) system is simply a mechanism which links an automatic firearms firing trigger to its breech bolt catch so that the firing trigger will secondarily supply the mechanical action by which the firearms breech bolt catch can be released and thus, when reloading, the firearms breech bolt will close the breech, to chamber the first round of a fresh magazine by simply squeezing the firing trigger, rather than fumbling for a separate catch mechanism like a thumb operated catch which is the standard device used by todays automatic pistols.

This system should be used in conjunction with an index finger operated magazine catch because this will insure that the index finger is taken off the firing trigger when the firearms empty magazine is removed and thus the breech is unlikely to be accidentally closed before a full magazine can be inserted into the firearms magazine well.

When this device is used by a semi-automatic firearm, the first squeeze of the trigger will close the breech, if open, any additional squeezes will, each, discharge a single round.

When this device is used by a fully automatic firearm, one squeeze of the trigger will close the breech, at which point the firearm will begin firing continuously until the trigger is released, therefore, a fully automatic firearm which normally fires in the closed bolt position, will also fire from its open bolt position.

The Spinning-Lock Breech Bolt and Breech Bolt Receiver (SLR) system is named after its new type of safety system, although this breech bolt and its receiver are also new in design.

The breech bolt is the key element of this system as all other components of this system were designed to accompany the breech bolt.

This new telescoping L-shaped breech bolt differs when compared to previous sub-machine gun L-shaped breech bolts in that its recoil limit is established by a mechanical interaction with a firearms barrel rather than a stop bumper behind the breech bolt, which negates the need for any portion of a breech bolt receiver to be rearward of the firearms barrel and the breech bolt is simply retained to the firearms barrel with a mailbox-like hood. An action spring inside the assembly loads it forward to the breech closed position.

This breech forward receiver design allows the breech bolt to open and close the breech in full view and even when this breech bolt is in the closed position, the barrel throat can be seen through the shell headspace gap, which is a space between the breech bolt and the rear end of the barrel, from either side. The gleaming brass of a chambered round shows up like a red light in this firearm and thus there is never any question of whether or not it is loaded.

All components of the spinning-lock mechanism are retained to the breech bolt and they act in the following ways. Locking balls protrude from the inside of the breech bolt as they are parted by a spring loaded wedge so that they will engage recesses in the receiver to lock the breech bolt in the breech closed position, when fired, the balls retract, from the forces of detonation, allowing the bolt to recoil and reload. The wedge is linked to the breech bolts manual operating handle so that it unlocks the breech as well as operates the breech bolt manually. A rotating, notched shaft locks the manual operating handle to, and releases it from, the breech bolt thus allowing or disallowing the manual operating handles independent movement from the breech bolt, required to unlock the breech. This same rotating lockshaft, which locks and unlocks the operating handle, simultaneously locks and unlocks the firing pin which is also contained inside the breech bolt. The lockshaft is operated by a well hidden thumb wheel.

Locking the operating handle, which in turn locks breech bolt, prevents the firearm from being loaded by someone who should not be fooling with it.

Locking of the firing pin acts as a safety device for someone who is familiar with the firearm and wants to prevent the accidental discharge of a chambered round.

No trajectory sighting system is claimed in the patent application noting that the breech bolt hood provides a very rigid mounting surface for whatever sights are chosen by the firearms owner.

The ejection components are of a generic nature and none are claimed in this patent application.

This new Detachable Firing Assembly is exactly that but, differs from previously used detachable firing assemblies in that it is retained to the firearm without separate fasteners and can be removed or installed instantly which makes this the ultimate child safety device because now we have a two piece firearm. This firing assembly can be kept someplace other than on the firearm, such as on the owners keychain. By using the horn of a firearms detachable cartridge magazine as a tool for removing a firing assembly, we negate the need for a separate tool, although, any blade-like object such as screwdriver, knife or even a coin will do the job.

The new handgun Gripframe which combines these systems into a single firearm, is fabricated from sheet metal rather than a forging due to the fact that the Detachable Firing Assembly houses the components that were previously built into the rear area of the gripframe and in order for the gripframe to house the Trigger Operated Breech Bolt Lockback Releasing System it must be hollow in the area above the firing trigger. Because of these reasons it is simpler and less expensive to fabricate the gripframe by joining two side plates with cross members.

The barrel of the Spinning-Lock Breech Bolt and Breech Bolt Receiver System sits on top of two plates and is joined to them and thus the barrel itself is part of the gripframe as this joint is the anchoring point for the entire Spinning-Lock Breech Bolt and Breech Bolt Receiver System. This fixed barrel design provides for great accuracy. An ejector stud affixed to the gripframe behind the barrel works in conjunction with whatever type of extractor hook is fitted to the breech bolt.

BRIEF DESCRIPTION OF SEVERAL VIEWS OF THE DRAWINGS

Note that, hatching, which inclines to the right, indicates components of the frame. Hatching, which inclines to the left, indicates moving components.

All moving parts act on a plane formed by length and height, the third dimension of depth is therefore only shown where necessary.

DETAILED DESCRIPTION OF THE INVENTION

Figure 1:
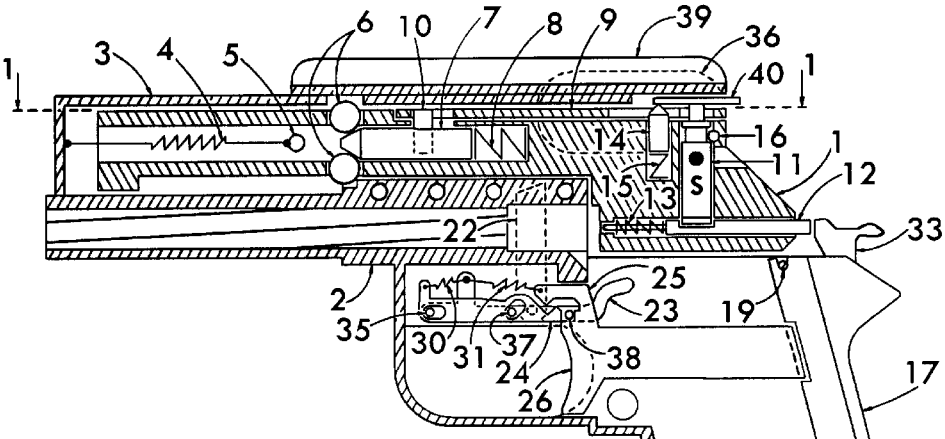
FIG. 1 is a left side cut-away view of the complete firearm with all of its components illustrated as showing their location and relationship to each other while the breech bolt is locked in its closed position.

This patent application has been divided into four sections because four new and separate devices have been combined into this single firearm invention.

The first is a new telescoping breech bolt and breech bolt receiver system named the Spinning Lock Breech Bolt and Breech Bolt Receiver System (SLR) referred to in FIGS. 1, 3, 4, 5, 6, 7, 13 and 14.

In this design the long leg of an L-shaped breech bolt 1 lays on top of a firearm barrel 2 and is retained to it by a breech bolt hood 3 but not tightly so as to allow the breech bolt 1 to reciprocate freely. The U-shaped sight mount 39 reinforces the breech bolt hood 3 as they are welded together.

A tension spring 4 tethers from the inside front wall of breech bolt hood 3 to a crosspin 5 inside the breech bolt 1 loading it forward.

A lug which projects downward from the underside of the breech bolts 1 front end interacts with a step in the firearms barrel 2 to limit the breech bolts 1 rearward motion.

This breech bolt 1 has a built-in locking system which holds the breech bolt 1 in its closed and forwardmost position as shown in FIG. 1. Two locking balls 6, one protruding upward and the other downward from the breech bolt 1 to engage a recess in the breech bolt hood 3 and a recess in the barrel 2 while being parted vertically by a spring loaded bullet wedge 7 that is loaded forward by a compression spring 8.

When this firearm is fired, the severe rearward forces of detonation causes the locking balls 6 to retract into the breech bolt 1 as the wedge 7 withdraws from them allowing the breech bolt 1 to recoil and reload.

In order to operate the breech bolt 1 manually the breech has to be unlocked first as it takes several hundred pounds of rearward force to operate the breech bolt 1 otherwise.

A breech bolt manual operating handle 9 is linked to the bullet wedge 7 by its retaining pin 10 which passes vertically through a longitudinal slot in the top surface of the breech bolt 1 as the retaining pin 10 distends a longitudinal slot in the manual operating handle 9 which is blade-like and lays flat on the top of the breech bolt 1 while being sandwiched against the upper inner surface of the breech bolt hood 3.

The rear end of the blade-like manual operating handle 9 laterally joins a right and left side grip pad.

Figure 3:
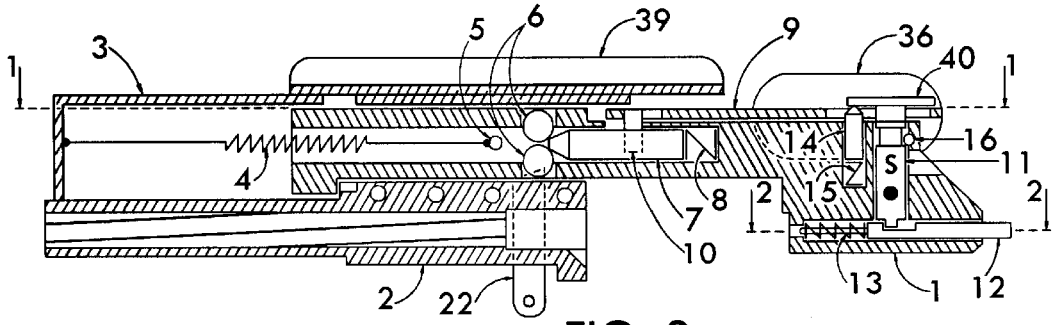
FIG. 3 is a left side cut-away view of the SLR system only with its components illustrated as showing their location and relationship to each other while the breech bolt is in its open position.
Figure 4:
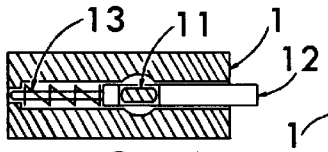
FIG. 4 is a cross sectional view taken from FIG. 3 along the line 2—2 altered to illustrate the rotating lockshaft locking the firing pin.
Figure 6:
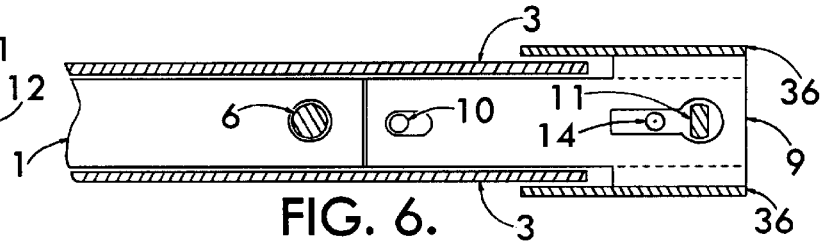
FIG. 6 is a portion of the cross sectional view taken from FIG. 1 along the line 1—1 illustrating the rotating lockshaft locking the breech bolt manual operating handle.
Figure 5:
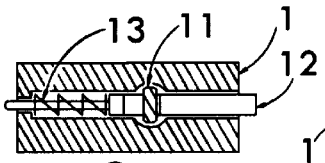
FIG. 5 is a cross sectional view taken from FIG. 3 along the line 2—2 altered to illustrate the rotating lockshaft while unlocked and firing pins position when struck.
Figure 7:
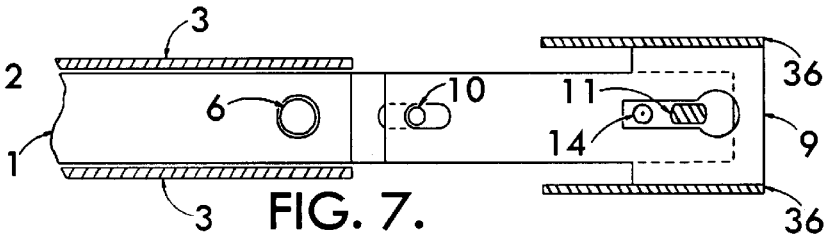
FIG. 7 is a portion of the cross sectional view taken from FIG. 3 along the line 1—1 illustrating the rotating lockshaft while unlocked and the breech bolt manual operating handle while drawn.

By gripping the pads, indicated generally as 36, the manual operating handle 9 can be drawn rearward as well as the bullet wedge 7 to unlock the breech until the wedge retaining pin 10 reaches the rear end of the slot in the breech bolt 1 at which point the breech bolt 1 will move rearward with the manual operating handle 9 until it reaches its recoil limit as shown in FIG. 3. The breech bolt catch 22 may engage the notch in the breech bolt 1 while in this position.

Referring to FIGS. 1, 3, 4, 5, 6 and 7 the Spinning Lock Safety System is a thumb wheel operated, notched rotating lockshaft 11 which retains to the breech bolt 1, and controls the position and movement of, the manual operating handle 9 and breech bolt's firing pin 12 by passing through a keyhole slot in the rear end of the manual operating handle 9 and sitting in a vertical bore in the rear end of the breech bolt 1 while the bottom end of the rotating lockshaft 11 distends a notch in the firing pin 12 which is spring loaded rearward by a compression spring 13.

The detent pin 14 and a compression spring 15 are stacked in a vertical bore just in front of, and parallel to, the rotating lockshaft 11 while the detent pin 14 is loaded upward to pass through the keyhole slot in the manual operating handle 9 and contacts the underside of the thumb wheel 40 which is affixed to the top end of the rotating lockshaft 11. The rear end of the manual operating handle 9 is sandwiched between the lockshafts thumb wheel 40 and the top surface of the breech bolt 1.

The rotating lockshaft 11 acts to change the revolutionary location of flats notched into it and to provide the means by which the manual operating handle 9 and the firing pin 12 are locked and unlocked simultaneously as demonstrated by the cross sectional views of FIGS. 4, 5, 6 and 7 which are taken from FIGS. 1 and 3 at lines 1—1 and 2—2.

A pin 16 is press fit into a lateral hole in the breech bolt 1 intersecting the rotating lockshafts bore and distends in a circumferential groove in the rotating lockshaft 11 so as to retain it while allowing it to rotate freely in both directions.

The revolutionary position of the rotating lockshaft 11 and lock status of SLR system is visually determined by colored status symbols on the circumferential surface of rotating lockshaft 11 that appear in window(s) in the rear end and (or) both sides of the breech bolt 1.

Figure 2:
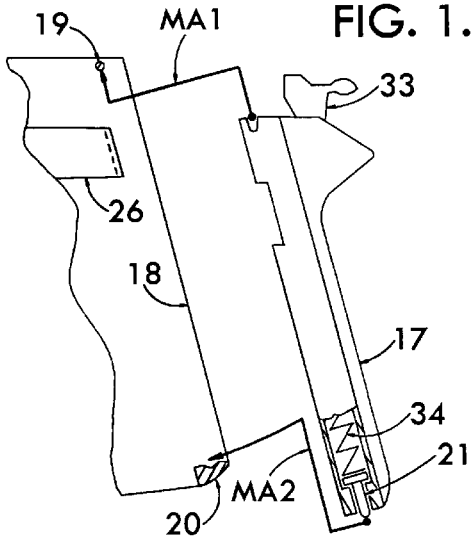
FIG. 2 is a left side cut-away view of the firearm gripframes extreme rear end only, shown with the Detachable Firing Assembly detached from it.

The second, referring to FIGS. 1 and 2, is a Detachable Firing Assembly Housing 17 which attaches to and detaches from this firearms gripframe 18 without any separate fasteners, so as to render this firearm inoperable instantaneously by simply removing it from the firearm.

The upper end of the Detachable Firing Assembly Housing 17 is grooved so that it saddles the upper cross member 19 which joins the side plates of the gripframe 18 at its rear and upper area.

The lower end of the Detachable Firing Assembly Housing 17 has a spring loaded ballpoint holding pin 21 projecting slightly from it, downward, which engages a ramp and recess in the lower cross member 20 which joins the side plates of the gripframe 18 at its rear and lower area.

Referring to FIG. 2 the Detachable Firing Assembly Housing 17 is installed into the gripframe 18 by two motions.

Motion arrow 1 (MA1) shows how the upper end of the housing 17 is put between the side plates of the gripframe 18 and slid upward until the groove in the housing 17 rests on the upper cross member 19.

Motion arrow 2 (MA2) shows how the lower end of the housing 17 drops into the gripframe 18 and the holding pin 21 will retract as it engages the ramp in the lower cross member 20 until the housing 17 is fully seated in the gripframe 18 at which point the holding pin 21 seats in a recess in the lower cross member 20 so as to hold the housing 17 firmly in the gripframe 18 without fasteners as shown in FIG. 1. The firing hammers 33 loading spring 34 also loads the holding pin 21.

The Detachable Firing Assembly Housing 17 is easily removed by simply prying the Housing 17 from the gripframe 18 with any blade-like object as a notch in the rear edge of either of the gripframe 18 side plates will provide a prying space.

The third is the Trigger Operated Breech Bolt Lockback Releasing System whose operation is, and components are, discussed on a step by step basis as shown by FIGS. 1, 3, 8, 9, 10, 11 and 12.

Figure 12:
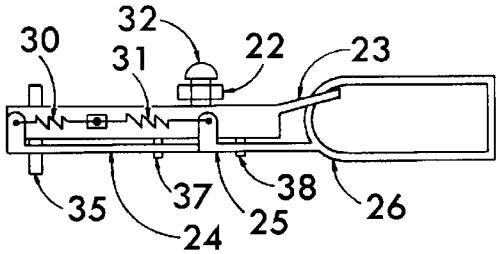
FIG. 12 is a top view provided to show the lateral orientation of the TLR systems components.

Referring to FIG. 12 the breech bolt catch 22 is linked to the breech bolt catch engaging lever 23 by a machine screw 32.

Figure 8:
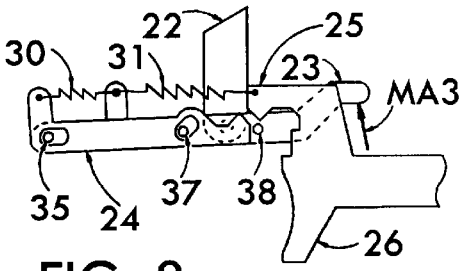
FIG. 8 is a left side view of the TLR system's constituents in mechanism at the moment the breech bolt catch engages the breech bolt while the firing trigger is depressed.

Referring to FIG. 8 the breech bolt catch 22 engages the fully recoiled breech bolt 1 as it, is linked to and, moves upward with the breech bolt catch engaging lever 23 which hinges on cross pin 35 and the engaging levers 23 rear end is forced to arc upward indicated by motion arrow 3 (MA3), by the rising feeder of an empty cartridge magazine after the last round in the firearm has been discharged so that the breech bolt 1 is locked in its open position as shown in FIG. 3. Tension spring 30 loads the cam following lever 24 rearward and tension spring 31 loads the firing trigger 26 forward and the breech bolt catch engaging lever 23 downward.

Figure 9:
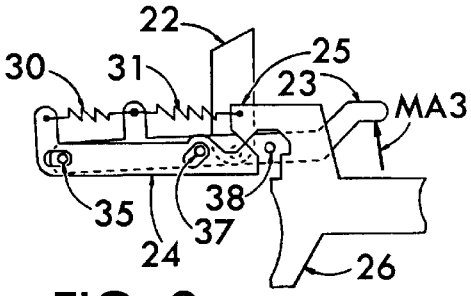
FIG. 9 is a left side view of the TLR system's constituents in mechanism showing the cam following levers secondary action as the firing trigger is released thus moving the sliding cam forward.

Referring to FIG. 9 the cam following lever's 24 secondary tangential motion allows the breech bolt catch 22 to remain engaged and escape the forward motion of the sliding cam 25 as the firing trigger 26 is released and allowed to reset in its normal fashion. A stud pin 37, which projects from a flat side of the breech bolt catch engaging lever 23 as well as hinge pin 35 passes through slots in the blade-like cam following lever 24, to allow the secondary action, as shown by FIG. 12 also.

Figure 10:
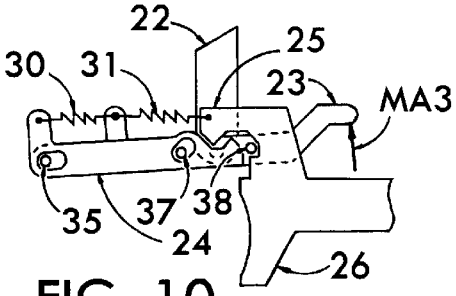
FIG. 10 is a left side view of the TLR system's constituents in mechanism while the breech bolt catch is engaged and the firing trigger has reset.

Referring to FIG. 10 the firing trigger 26 has reset fully while the breech bolt catch 22 still locks the breech bolt 1 in its open position as the firing triggers 26 forward travel is limited by a stud pin 38 which projects from the breech bolt catch engaging lever 23 and while at this position the stud pin 38 engages a notch in the extension arm of the sliding cam 25 which is affixed to the trigger 26, and thus locking the breech bolt catch engaging lever 23 up and thus further the breech bolt catch 22 so as to prevent its accidental disengagement from the breech bolt 1 when the firearm has been subjected to an accidental shock.

Figure 11:
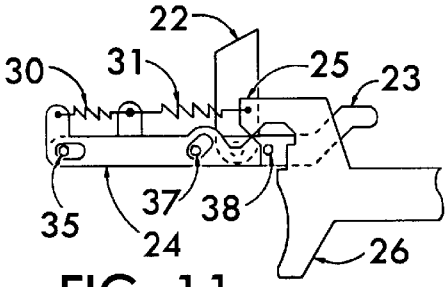
FIG. 11 is a left side view of the TLR system's constituents in mechanism at the moment the breech bolt catch is disengaged by the rearward motion of the sliding cam.

Referring to FIG. 11 the breech bolt 1 is released by drawing the firing trigger 26 which also moves the sliding cam 25 rearward to engage the cam following lever 24 forcing both it and the breech bolt catch engaging lever 23 to arc downward as this action pulls the breech bolt catch 22 downward disengaging it from the breech bolt 1 and thus the breech bolts action spring 4 forces the breech bolt 1 to the closed position as shown in FIG. 1, this view also shows the firing trigger 26 in its firing position as the sliding cams 25 extension arm rests on stud pin 38.

The fourth and last is a Gripframe 18 which is fabricated by welding sheet metal parts together rather than a one piece forging. This firearm fabrication method is ideally suited for this firearm because it has so many internal components and its firing mechanism is housed by a removable forging.

Figure 13:
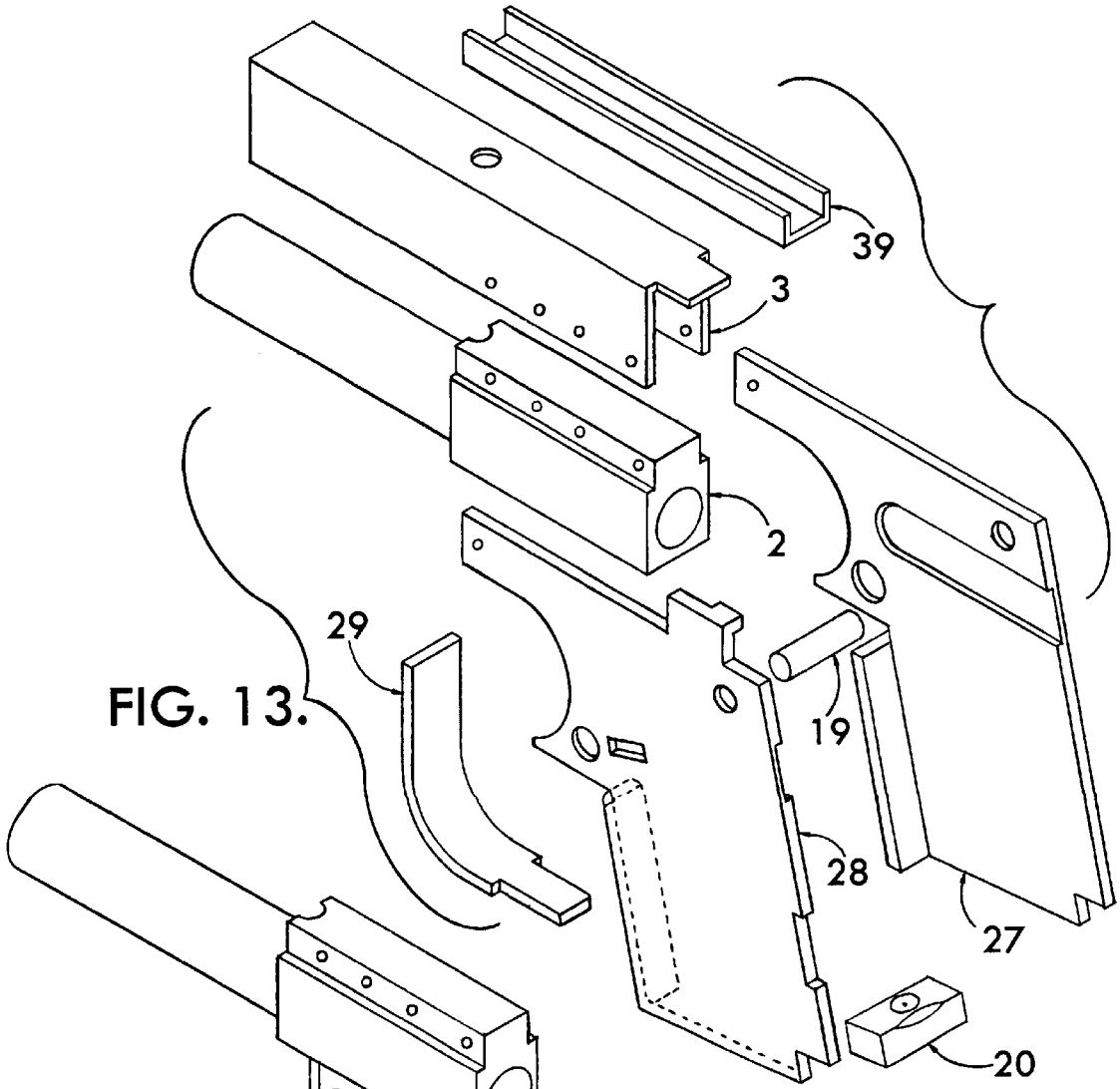
FIG. 13 is an exploded rear perspective of the gripframes components.
Figure 14:
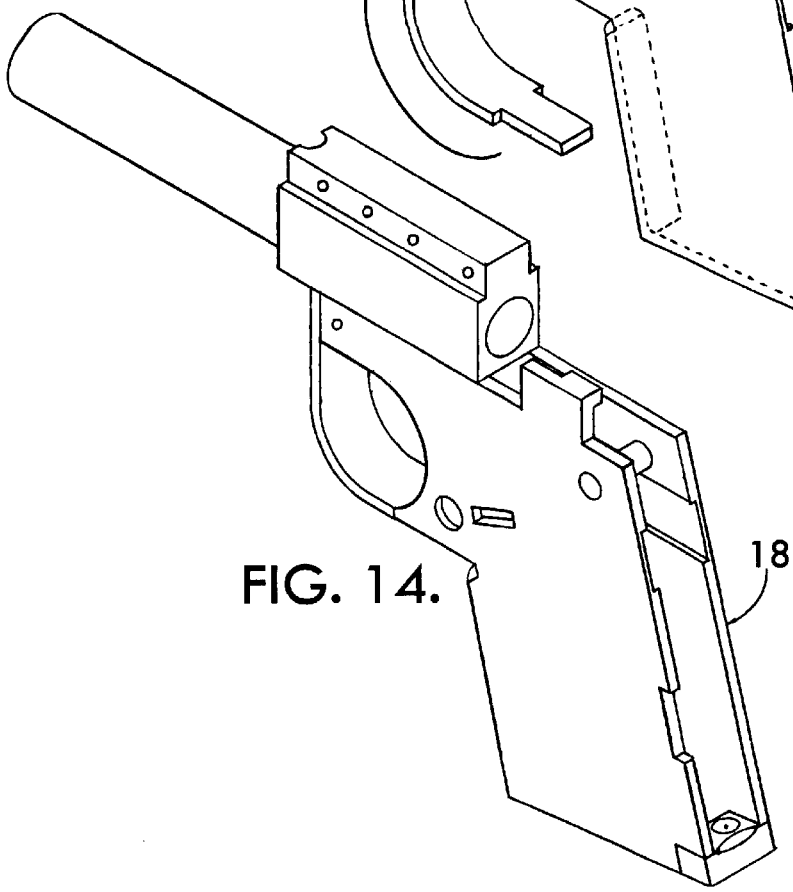
FIG. 14 is a rear perspective view of the gripframe.

Referring to FIGS. 13 and 14 the right 27 and the left frame plate 28 are joined by a flange projecting from each plate, towards each other, to form the front wall of the magazine well. The extreme rear end of the right 27 and the left frame plate 28 are joined at the top by a round cross member 19 and at the bottom by a rectangular cross member 20. The trigger guard 29 is an L-shaped bar which joins the nose of the right 27 and left frame plate 28 and also joins the plates just below the trigger area. The most unique feature of this firearm gripframe 18 is that the barrel 2 acts as stressed member in the gripframe 18 by joining the right 27 and left frame plate 28 at the upper front area of the gripframe 18.

I hereby claim:

1. A firearm comprising:

a barrel and an L-shaped breech block;

a breech bolt hood located above said barrel and at least partially enclosing the breech block;

an operating handle sandwiched between the breech block and the breech bolt hood when in a first locked position and located rearward of the breech block hood when in a second unlocked position;

a firing pin spring biased in the L-shaped breech block;

a locking means to lock the breech block in a closed position;

a rotating lockshaft located in an opening in the breech block wherein the rotating lockshaft blocks motion of the operating handle and the firing pin when in a locked position and permits motion of the operating handle and the firing pin when in an unlocked position.

2. A firearm of claim 1 wherein;

the locking means comprises locking balls located in apertures of the L-shaped breech block.

3. A firearm of claim 1 wherein;

the rotating lockshaft is attached to a thumbwheel which is manually operated and responsible for determining the position of the rotating lockshaft.

4. A firearm of claim 3 wherein;

a detent pin interacts with the thumbwheel to limit movement of the thumbwheel.

* * * * *